US009091091B2

(12) United States Patent
Sicking et al.

(10) Patent No.: US 9,091,091 B2
(45) Date of Patent: Jul. 28, 2015

(54) ENERGY ABSORBING SPORTS BOARD ASSEMBLY

(71) Applicants: Dean L Sicking, Indian Springs, AL (US); Cody S. Stolle, Lincoln, NE (US)

(72) Inventors: Dean L Sicking, Indian Springs, AL (US); Cody S. Stolle, Lincoln, NE (US)

( * ) Notice: Subject to any disclaimer, the term of this patent is extended or adjusted under 35 U.S.C. 154(b) by 0 days.

(21) Appl. No.: 13/939,320

(22) Filed: Jul. 11, 2013

(65) Prior Publication Data

US 2015/0013239 A1 Jan. 15, 2015

(51) Int. Cl.

| | |
|---|---|
| ***E04B 1/98*** | (2006.01) |
| ***E04H 3/00*** | (2006.01) |
| ***A63C 19/10*** | (2006.01) |
| *A63C 19/00* | (2006.01) |
| *A63C 19/08* | (2006.01) |

(52) U.S. Cl.

CPC *E04H 3/00* (2013.01); *A63C 19/10* (2013.01); *A63C 19/00* (2013.01); *A63C 2019/085* (2013.01)

(58) Field of Classification Search

CPC ... A63C 19/10; A63C 2019/085; E01F 15/08; E01F 15/086; E01F 15/088; E04B 1/344; E04B 1/985

USPC ..... 52/71, 223.7; 472/92, 94; 256/24–26, 256/29–31

See application file for complete search history.

(56) References Cited

U.S. PATENT DOCUMENTS 3,849,935 A * 11/1974 Hale ..... 49/34
4,681,302 A * 7/1987 Thompson ..... 256/13.1
4,883,267 A * 11/1989 Burley ..... 472/90
4,927,134 A * 5/1990 Burley ..... 472/90
5,394,927 A * 3/1995 Huebner ..... 160/327
5,863,030 A * 1/1999 Kotler et al. ..... 256/24
5,882,140 A * 3/1999 Yodock et al. ..... 404/6
5,921,702 A * 7/1999 Fitch ..... 404/6
5,953,882 A * 9/1999 Vallance et al. ..... 52/766
6,004,217 A * 12/1999 Johnston et al. ..... 472/92
6,004,218 A * 12/1999 Keating et al. ..... 472/94
6,059,491 A * 5/2000 Striefel et al. ..... 405/111
6,106,401 A * 8/2000 McAlpine ..... 472/92
6,155,022 A * 12/2000 DeCanio et al. ..... 52/766
6,413,009 B1 * 7/2002 Duckett ..... 404/6
6,551,429 B1 * 4/2003 McAlpine ..... 156/157
6,783,461 B2 * 8/2004 Frazier et al. ..... 472/92
7,234,275 B1 * 6/2007 Haggy et al. ..... 52/71
7,708,492 B2 * 5/2010 Carey ..... 404/6
7,765,724 B2 * 8/2010 Walker ..... 37/219
7,811,025 B2 * 10/2010 Kulp et al. ..... 404/6

(Continued)

FOREIGN PATENT DOCUMENTS

WO WO 2008152210 A1 * 12/2008 ..... A63C 19/06
WO WO 2010105353 A1 * 9/2010 ..... A63C 19/10

*Primary Examiner* — Brent W Herring

(57) ABSTRACT

An energy absorbing sports board assembly that is not fixed to the floor of the arena but is allowed to move relative to the arena floor. The system utilizes vertical and horizontal tension to return the structure to its original position after deflection from impact from within the playing surface of the sports arena. The bottom portion, which is covered with a dasher board, rotates relative to the see-through material making up the top portion (glass). Because the sports board system is not attached to the floor of the arena, hockey players sliding along the ice during a hockey game are protected from concussion and paralyzing injuries to a greater extent than current systems which are fixed to the arena floor. The flexible connection between panels allows one or more panels to slide outward from the playing surface on impact.

21 Claims, 5 Drawing Sheets

(56) References Cited

U.S. PATENT DOCUMENTS

| | | | | |
|---|---|---|---|---|
| 7,914,385 | B2 * | 3/2011 | Palumbo et al. | 472/92 |
| 7,931,422 | B2 * | 4/2011 | Kulp et al. | 404/6 |
| 8,235,625 | B1 * | 8/2012 | Kulp et al. | 404/6 |
| 8,250,818 | B2 * | 8/2012 | Tremblay et al. | 52/167.3 |
| 8,376,651 | B2 * | 2/2013 | Kulp et al. | 404/6 |
| 8,491,217 | B2 * | 7/2013 | Kulp et al. | 404/6 |
| 8,496,395 | B2 * | 7/2013 | Miracle | 404/6 |
| 8,573,565 | B1 * | 11/2013 | Lyndaker et al. | 256/23 |
| 8,734,046 | B2 * | 5/2014 | Miracle | 404/6 |
| 2002/0025221 | A1 * | 2/2002 | Johnson | 404/6 |
| 2012/0001139 | A1 * | 1/2012 | Riley et al. | 256/24 |
| 2012/0060265 | A1 * | 3/2012 | Guertin | 2/411 |
| 2013/0040745 | A1 * | 2/2013 | Kapsalis et al. | 472/94 |
| 2013/0040746 | A1 * | 2/2013 | Kapsalis et al. | 472/94 |
| 2013/0307181 | A1 * | 11/2013 | Kulp et al. | 264/229 |
| 2014/0008595 | A1 * | 1/2014 | O'Banion et al. | 256/24 |

* cited by examiner

ENERGY ABSORBING SPORTS BOARD ASSEMBLY

BACKGROUND OF THE INVENTION a. Technical Field

Protective barriers for a sports arena.

b. Description of the Prior Art

Ice hockey is a fast and sometimes violent sport. Research has shown that almost 6 percent of all professional hockey players suffer a concussion every season. Other studies have indicated that an average high school hockey player has a risk of approximately 1 in 2000 of experiencing a concussion during each practice or game in which they participate. Most high school teams have 20 or more players with an approximate 10 week season. If the average team has a game or practice 5 times per week, then the average team would experience a concussion once every year. There has been extensive focus on concussions over the last several years, hockey players continue to face paralyzing spinal cord injuries. Although these injuries are far less common than concussions, the effects are both catastrophic and permanent. Finally, most of the concussions associated with high school hockey and all of the paralyzing accidents involve a player striking the boards. If the existing board systems can be replaced with a more forgiving board system, many of the concussions and virtually all of the paralyzing accidents can be eliminated.

Current technology focuses primarily upon the barrier as a means to keep the hockey puck and the players within the playing field. Hockey pucks are hit at high speed and would injure spectators if not contained. The top portion of the barrier must be a of a see-through material so that the front rows of spectators can see through the barrier to the playing surface and yet be protected by it.

U.S. Pat. No. 4,883,267, Burley, discloses a dasher board system for sports arenas fixed to the floor through the ice of a hockey rink using a spring to permit a slight deflection and return the board system to its original position. The entire structure deflects when impacted on the playing surface side. A spring held in place with a bolt threaded through the ice to the floor secured by nut returns the board system after deflection caused by impact. The least deflection is closest to the impact of a player sliding along the ice. The entire structure deflects meaning that the see through top portion moves the most whereas impacts in that area are more likely to be with players standing hitting their shoulders and upper bodies. Head first impacts, most likely to result in concussions or paralyzing injuries, are more likely to occur with fallen players sliding on the ice or impacting near the floor of the arena.

U.S. Pat. No. 6,004,217, Johnston, discloses a flexible board assembly with shock absorbing features similar in theory (but different in structure) to the Burley '267 patent. The entire structure is fixed to the floor and pivots when impacted about a point slightly above the floor (ice in a hockey rink). This disclosure uses a two-part structure for the lower portion of the dasher board system. The structure pivots about a point slightly above the floor and uses an internal spring set to return the deflected assembly to its original position. This disclosure has no deflection at the very bottom where it is attached to the floor of the arena. Players sliding along the ice have little or no deflection when they impact the dasher board at this location.

U.S. Pat. No. 6,783,461 B2, Frazier, discloses placing a spring behind the panel to absorb the impact and deflect board system slightly. This is essentially a shock absorber system. It does not allow for a more substantial deflection (and hence energy dissipation) of the board system at the bottom, where the danger of head injury is the greatest.

U.S. Pat. No. 8,250,818 Tremblay discloses energy brace apparatus that dissipates the force that is substantially different from the present invention.

U.S. Patent Application Publication No. US 2012/0261867 A1, Gilkes, discloses a shock absorber system for the glass where a door allows access into the playing surface. This disclosure does not have the pivoting features of the present invention and does not absorb and dissipate energy close to or at the playing surface.

Additional dasher board or barriers for hockey rinks and similar sports stadiums are found in prior art. They primarily relate to the ease of construction or strength such as World Intellectual Property Organization Publication No. WO2008/152210 A1 which discloses a board structure for ice hockey rink and contains references to several United States patents. The primary focus of this disclosure is to make it easier to move and reassemble the ice hockey rink board structure.

SUMMARY OF THE INVENTION

The objective of the energy absorbing sports board assembly described herein is to provide a more forgiving wall that deflects sufficiently to reduce peak g loading experienced during high speed impacts to approximately half of the values associated with the conventional board system. Decreasing g loading by 50% should have a dramatic effect on the safety performance of hockey boards. The most likely occasion for a head first impact by a player is in the lower portion of the dasher board system. Players falling and sliding along the ice or falling as they impact the board are most likely to hit their head on the board and particularly head first impacts occur in this area. This system provides the greatest energy absorption closest to the playing surface.

The energy absorbing hockey board system relies upon six design features to reduce the g loading experienced by an impacting player and prevent movement when impacted by a puck. These design features include a high strength steel tubing frame system filled with structural foam; hinges that allow each wall panel to rotate with respect to the adjacent panel and allow the panel spacing to change; a pre-tensioned spring system that restrains the board when struck by a puck; pre-tensioned cables that provide compression loading to the wall panel system and help restore the wall panel after a player impact; a ramp system supports the energy absorbing wall panels; and a hinge system that allows the wall panels to rotate several degrees relative to the see through material (commonly called glass even if made of another material) that is placed above the dasher board panel, but also produces a moment that both resists motion of the panel relative the glass and begins to accelerate the glass laterally.

The goal of any impact attenuation system is to extend the duration of the impact in order to reduce accelerations that must be imparted to the people or objects involved in the collision. In the case of hockey boards, the wall system must be allowed to deflect laterally when struck by a player in order to extend the duration of the impact and reduce the forces applied to the player.

The weight of most existing wall panels is concentrated in the heavy walled steel or aluminum tubes used in its construction. The energy absorbing board system replaces the heavy walled tubes with high strength steel tubes filled with a structural foam to increase its rigidity. Although the light weight wall panel weighs less than one-third of the conventional systems, the bending stiffness of the two systems are comparable. Full-scale testing of wall panels has shown that the inertia of conventional board designs is sufficient to produce a significant risk of injury, even if it was not attached to the floor. Hence, the reduction in mass of the high strength tubular steel frame with structural foam insert is critical to the reduction of injury risk associated with hockey players striking the boards.

The flexibility of the energy absorbing hockey boards is also key to reducing the injury risk of players. Flexibility is provided by the extendable hinges used to attach adjacent wall panels to each other. The hinges allow the wall panels to rotate relative to each other to facilitate lateral motion of the wall system. However, the length of the wall system must increase when panels are pushed rearward. Thus, the wall panel hinges incorporate an extension feature that allows the stretching of the wall system when it deflects rearward. The extendable hinges utilize pins inserted into short slots. The slots allow two adjacent wall panels to move apart when pushed back and come back together when the boards are pulled back into alignment after the impact is completed. Note that the slots can be filled with a soft rubber grommet or other material to increase the restoration forces in the system.

Low stiffness springs are utilized to provide a pre-tension system that prevents the boards from moving when impacted by a puck. Although there are a number of ways to attach the springs, the preferred embodiment involves orienting the springs vertically and attaching a cable that extends down the back the board system and is attached under the ramps used to support the wall panels. In this configuration, the pre-tensioned springs produce a lateral load on the bottom of the boards that resist any motion. However, because the springs have a very low stiffness, the forces on the wall do not increase rapidly. This feature minimizes the forces applied to the players, especially during the critical wall acceleration period when the mass of the wall is resisting its movement.

The wall system also utilizes pre-tensioned cables to produce compression in the wall panels and resist large lateral deflections of the wall system. Compression in the wall panels assures that the system will return to its original length when it is pushed back into place by the springs, cables, and ramp system. Failure to incorporate the compression can lead to the wall locking up because the extendable hinges don't return to their original length. The tension cables also provide stopping forces late in the impact period when the wall has reached the limit of motion and the player's velocity has been dramatically reduced.

The ramp system provides two key features to the barrier system, a restoring force that minimizes the forces that must be placed in the spring in order to bring the wall panels back to their proper location after an impact, and a method of assuring that the wall panel rotates about the top of the panel. A six to one slope from the playing surface side (front) to the spectator side (back) works best. Other slopes also can work. Minimizing the wall panel spring forces further reduces the forces applied to the player during the critical wall panel acceleration period. The ramp helps to force the top of the panels to remain more-or-less stationary. This is accomplished by arranging the ramp angle to roughly match the motion of the base that would correspond to a rotation about the top of the panel. Restricting motion of the top of the panel helps to reduce movement of the glass. This is another critical feature because the glass is the most massive component of the wall system and allowing it to move would greatly increase the inertia of the wall panel and thereby increase the resistance of the wall to acceleration and greatly increase the forces applied to an impacting player.

The final critical component of the hockey boards is the hinge configuration used to attach the glass support poles to the top of the wall panels. An oversized tube is used on the wall panel to allow the support poles to be inserted into the top of the panel. Because the wall panel tube is oversized, the glass support pole can rotate about the top of the panel. This allows the wall panel to move without rapidly accelerating the heavy glass. Finally, foam rubber is placed into the oversized wall panel tube to provide some resistance to movement of the wall panel. The foam assures that, when impacted at a high rate of speed the wall panel will deflect significantly without requiring the glass to move. However, some moment is applied to the glass support poles to initiate a slow movement of the glass which helps to prevent a large inertial spike when the available hinge motion is exhausted.

DETAILED DESCRIPTION OF THE PREFERRED EMBODIMENT

Figure 1:
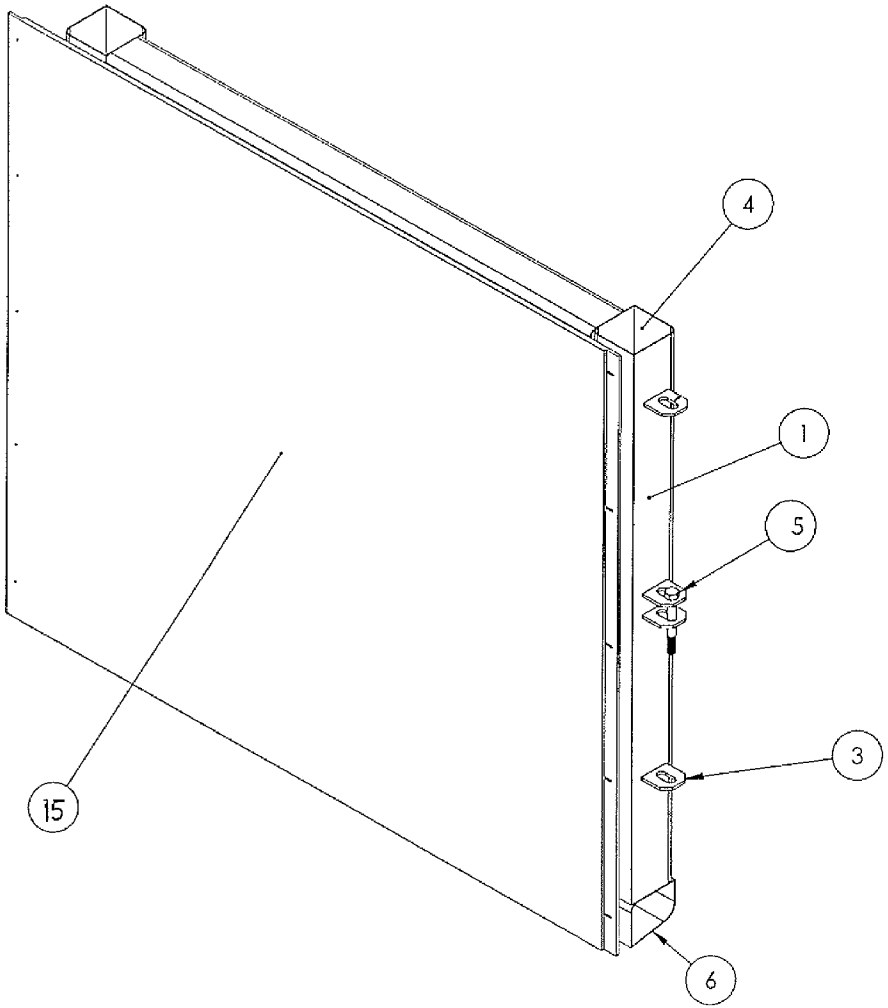
FIG. 1 is a view from the spectator side.
Figure 2:
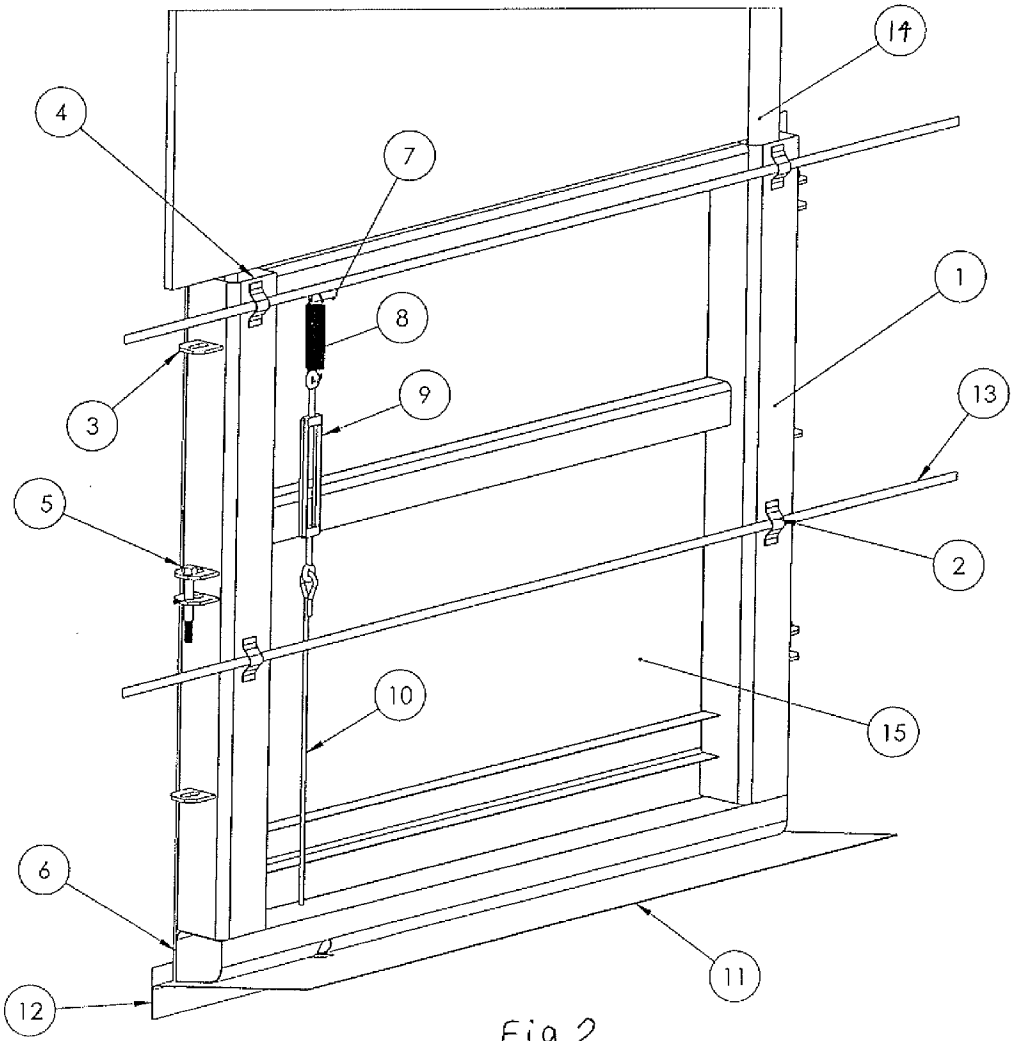
FIG. 2 is a view from the playing surface side.
Figure 3:
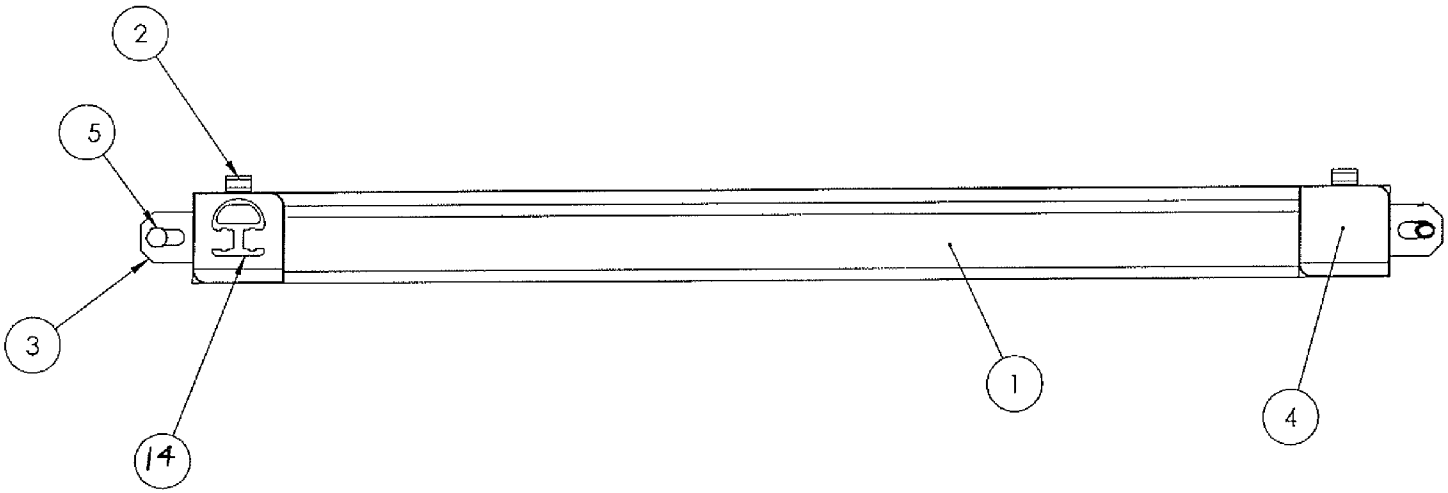
FIG. 3 is a top view of a panel without the glass.
Figure 4:
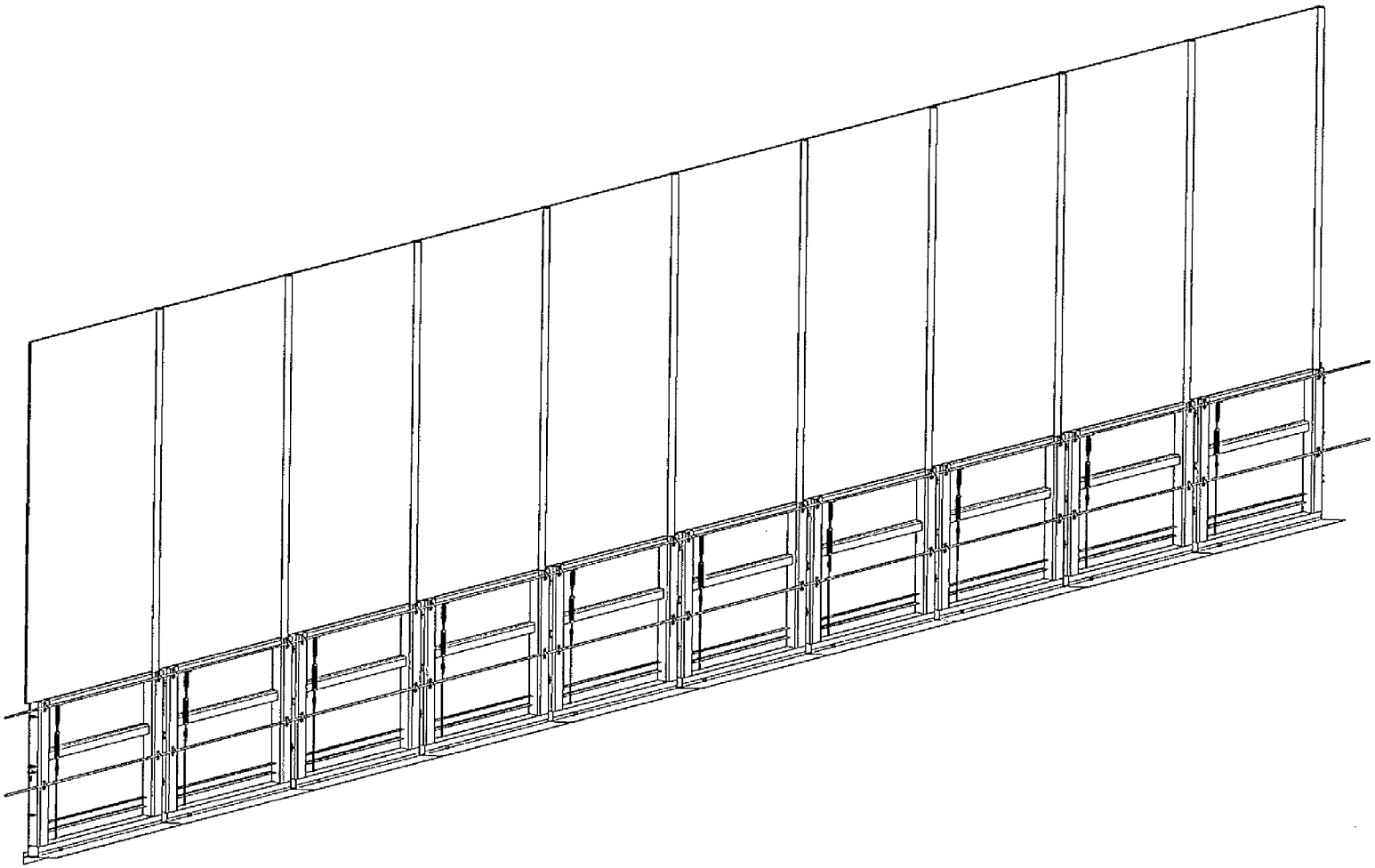
FIG. 4 is view from the spectator side of several panels connected.
Figure 5:
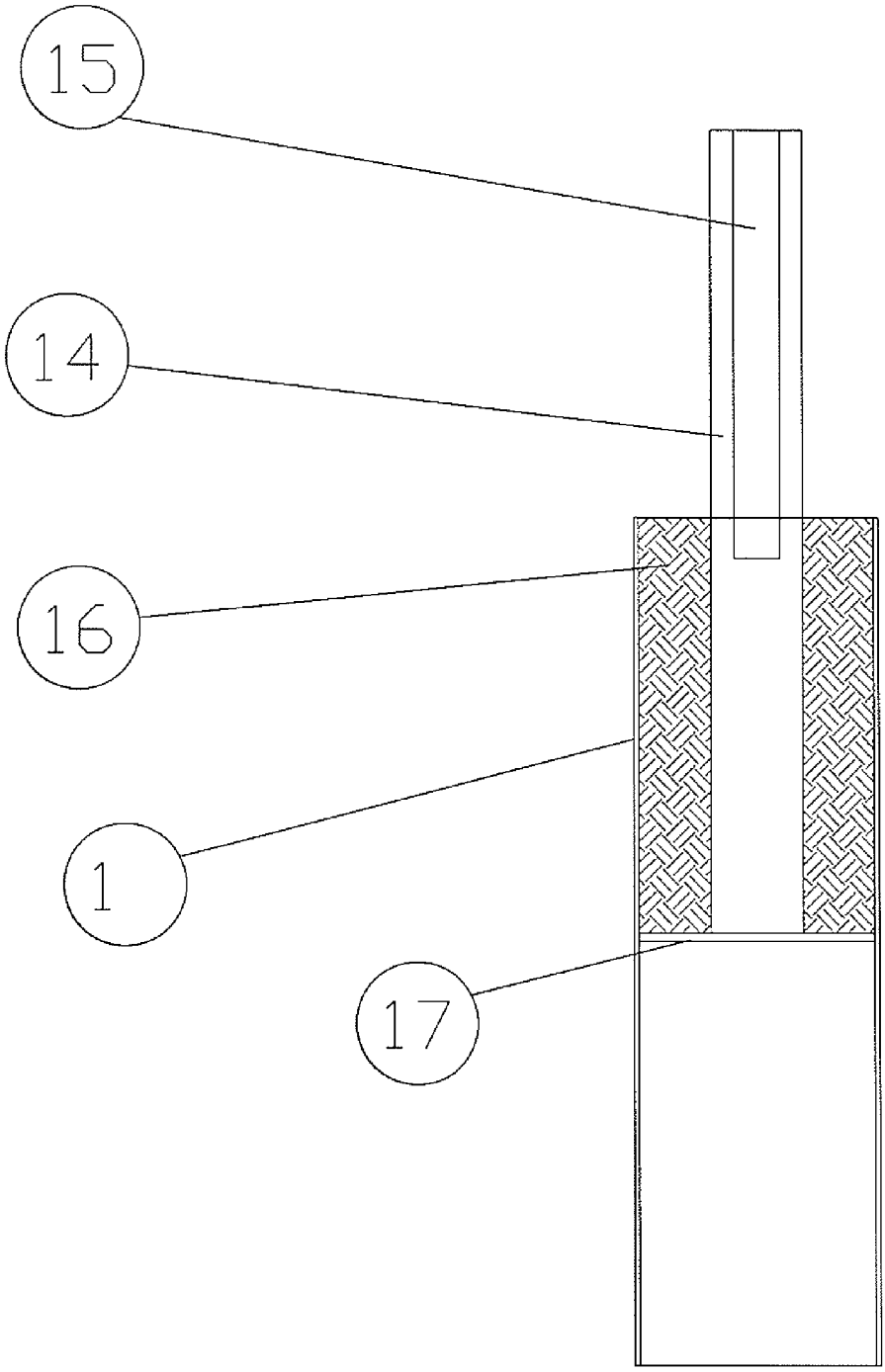
FIG. 5 is a side view of the glass mounting.

Frame 1 is of generally rectangular shape composed of tubular material adapted with a slot in the bottom of frame 1 suitable for allowing a wire rope to be run through the opening and further adapted with the bottom portion having a slope. The frame can be of another shape, and need not be tubular, though a rectangular shape of tubular material is preferred. Wire rope brackets 2 are attached to frame 1. Wire rope 13 extends along the back of frame 1 and acts to provide horizontal tension to move the panels back to their original position when deflected. Springs, turnbuckles, and cables of any material will work as additional means that could be applied to the back of the frame to give a generally horizontal tension force to the frame when deflected. Wire rope is the most suitable means. Extendable hinges 3, adapted with short slots suitable for a pin to removably attach and connect the panel to another similar panel. Because of the slotted portion of the hinges, these are the preferred means. However, hinges, linkages chains, lines, wires, and rope could be used to connect one panel to another. Foam material 4 fills the tubular material of frame member 1. The frame could be solid or tubular. If tubular, a foam to stiffen the frame is preferred but not required for operation. A bracket 7 is attached to frame member 1. Any means for attachment will suffice, including welding, screw, nut and bolt, and cotter pin. Spring 8 is attached to bracket 7 and attached to turnbuckle 9. Wire rope 10 is attached turnbuckle 9. The wire rope is run through the slot in the bottom of the frame turns around the frame to connect to the back of the catch plate. The purpose of this is to provide vertical tension when the panel is deflected; consequently, rope and pulleys, block and tackle, cable, wire, springs, are acceptable alternative means for providing vertical tension to the frame. Ramp 11 is attached under framing member 1. Front catch plate 12 is attached to ramp 11. The ramp and the catch plate can be a one piece construction with the frame such that the frame is adapted to incorporate a ramp and catch plate structure. Dasher 15 is attached to the frame 1 on the playing surface side (front). Vertical glass support 14 is attached to frame 1 so as to permit the frame to rotate relative to the glass which will remain relatively stationary. This will form a pivot point. In the preferred embodiment, elastomeric foam 16 is in the space between the wall of the frame and the vertical glass support 14. Bolt 17 goes through the frame and supports the elastomeric foam and the vertical glass support 14 which rest on the bolt 17. The foam compresses when force is applied. When a force is applied to the bottom of the frame, the foam compresses most at the bottom inside and top outside of the foam. The foam applies increasing force in the opposite direction from the force applied to cause the frame to rotate and allows the frame to pivot in relation to the glass by compressing. When the force is applied to the frame higher up the foam can compress more uniformly but in varying degrees. Allowing the support post to slide within the wall panel allows the point of rotation of the frame to move up or down to minimize forces applied to an impacting player. Any compressible material, such as springs, rubber, or plastics will work. Elastomeric foam works best. Any means for attaching glass or other see through material to the frame will suffice to replace the preferred structure, including hinges, brackets, and clamps, a ball barring, ball and socket, ball joint, pin, or a slidable connection mounted between the frame and the bottom of the bracket or some other method, as long as the means permits the frame to rotate in relation to the glass. Glass 15 is attached to vertical glass support 14 and held generally vertical above frame 1. Any see through material will be sufficient, including plastic, safety glass, and composite materials. Pin 5 is mounted in the slot of two panels connecting them. This is used in the preferred embodiment; however if alternate means of connecting the panels is used, it may be omitted.

The invention claimed is:

1. An energy absorbing sports board assembly, comprising:

a catch plate having front surface facing a playing surface and a back surface opposite to the front surface of the catch plate;

a ramp adjacent to the back surface of the catch plate and having an upward angle with respect to the playing surface, the ramp having a top surface and a bottom surface opposite to the top surface;

a frame with a generally rectangular shape, the frame having a front facing the playing surface, a back opposite to the front, a bottom portion with a slope positioned on the top surface of the ramp, a top portion opposite to the bottom portion, and first and second side portions between the top and bottom portions, wherein the bottom portion of the frame with the slope on the top surface of the ramp can laterally deflect away from the playing surface during impact on the front of the frame and return back after the impact;

a first extension hinge extending out from the first side portion of the frame;

a second extension hinge extending out from the second side portion of the frame;

a first elongated slot in the first extension hinge;

a second elongated slot in the second extension hinge; and a dasher board on the front of the frame.

2. The energy absorbing sports board assembly of claim 1, further comprising:

foam filling within the frame to increase rigidity of the frame.

3. The energy absorbing sports board assembly of claim 1, further comprising:

a first rope connected to the frame for providing a vertical tension on the frame.

4. The energy absorbing sports board assembly of claim 3, further comprising:

a spring having a first end attached to the top portion of the frame and a second end connected to the first rope, wherein the spring generates the vertical tension, wherein the spring is position between the top and bottom portions of the frame and between the first and second side portions of the frame.

5. The energy absorbing sports board assembly of claim 3, wherein the first rope is attached to the catch plate.

6. The energy absorbing sports board assembly of claim 3, further comprising:

a rope slot through the bottom portion of the frame, wherein the first rope passes through the rope slot of the bottom portion of the frame and is attached under the ramp.

7. The energy absorbing sports board assembly of claim 3, further comprising:

a second rope positioned across the first and second sides of the frame to provide a horizontal compressive force on the frame to resist lateral movement of the frame away from the playing surface during an impact on the front of the frame.

8. The energy absorbing sports board assembly of claim 1, further comprising:

a flexible grommet within one of the first and second elongated slots.

9. The energy absorbing sports board assembly of claim 1, further comprising:

a transparent material support mounted within the frame at the top portion of the frame.

10. The energy absorbing sports board assembly of claim 9, further comprising:

an elastomeric material positioned between the transparent material support and the frame.

11. An energy absorbing sports board assembly, comprising:

a catch plate having front surface facing a playing surface and a back surface opposite to the front surface of the catch plate;

a ramp adjacent to the back surface of the catch plate and having an upward angle with respect to the playing surface, the ramp having a top surface and a bottom surface opposite to the top surface;

a frame with a generally rectangular shape, the frame having a front facing the playing surface, a back opposite to the front, a bottom portion with a slope positioned on the top surface of the ramp, a top portion opposite to the bottom portion, and first and second side portions between the top and bottom portions, wherein the bottom portion of the frame with the slope on the top surface of the ramp can laterally deflect away from the playing surface during impact on the front of the frame and return back after the impact;

a rope slot through the bottom portion of the frame;

a first rope connected to the frame, passing through the rope slot of the bottom portion of the frame and attached under the ramp, wherein the first rope is for providing a vertical tension on the frame;

a second rope positioned across the first and second sides of the frame to provide a horizontal compressive force on the frame to resist lateral movement of the frame away from the playing surface during an impact on the front of the frame; and a dasher board on the front of the frame.

12. The energy absorbing sports board assembly of claim 11, further comprising:

foam filling within the frame to increase rigidity of the frame.

13. The energy absorbing sports board assembly of claim 11, further comprising:

a spring having a first end attached to the top portion of the frame and a second end connected to the first rope, wherein the spring generates the vertical tension on the frame.

14. The energy absorbing sports board assembly of claim 13, wherein the spring is position between the top and bottom portions of the frame, and between the first and second side portions of the frame.

15. The energy absorbing sports board assembly of claim 11, wherein the first rope is attached to the catch plate.

16. The energy absorbing sports board assembly of claim 11, further comprising:

a first extension hinge extending out from the first side portion of the frame; and a second extension hinge extending out from the second side portion of the frame.

17. The energy absorbing sports board assembly of claim 16, further comprising:

a first elongated slot in the first extension hinge; and a second elongated slot in the second extension hinge.

18. The energy absorbing sports board assembly of claim 17, further comprising:

a flexible grommet within one of the first and second elongated.

19. An energy absorbing sports board assembly, comprising:

a catch plate having front surface facing a playing surface and a back surface opposite to the front surface of the catch plate;

a ramp adjacent to the back surface of the catch plate and having an upward angle with respect to the playing surface, the ramp having a top surface and a bottom surface opposite to the top surface;

a plurality of panels position on the ramp, each of the plurality of panel includes;

a frame with a generally rectangular shape, the frame having a front facing the playing surface, a back opposite to the front, a bottom portion with a slope positioned on the top surface of the ramp, a top portion opposite to the bottom portion, and first and second side portions between the top and bottom portions, wherein the bottom portion of the frame with the slope on the top surface of the ramp can laterally deflect away from the playing surface during impact on the front of the frame and return back after the impact;

a first rope connected to the frame for providing a vertical tension on the frame;

a first extension hinge having a first elongated slot and extending from the first side portion of the frame;

a second extension hinge having a second elongated slot and extending from the second side portion of the frame; and a dasher board on the front of the frame; and a second rope positioned across the first and second sides of the plurality of frames to provide a horizontal compressive force on the plurality of panels to resist lateral movement of the plurality of panels away from the playing surface during an impact on the fronts of the frames, wherein the first elongated slot of a first extension hinge of one panel of the plurality of panels overlaps the second elongated slot of a second extension hinge of an other panel of the plurality of panels that is adjacent to the one panel.

20. The energy absorbing sports board assembly of claim 19, further comprising:

a pin inserted into both of the first and second overlapping elongated slots such that the one panel and the other panel can move apart and come back together.

21. The energy absorbing sports board assembly of claim 20, further comprising:

a flexible grommet within one of the first and second elongated slots of the first and second overlapping elongated slots, wherein the pin is inserted through the flexible grommet.

* * * * *